US008740551B2

(12) United States Patent
Di Paola et al.

(10) Patent No.: US 8,740,551 B2
(45) Date of Patent: Jun. 3, 2014

(54) BLADE OUTER AIR SEAL COOLING

(75) Inventors: Franco Di Paola, Montreal (CA); Kapila Jain, Kirkland (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 864 days.

(21) Appl. No.: 12/839,459

(22) Filed: Jul. 20, 2010

(65) Prior Publication Data

US 2011/0044801 A1 Feb. 24, 2011

Related U.S. Application Data

(60) Provisional application No. 61/234,849, filed on Aug. 18, 2009.

(51) Int. Cl.
*F04D 31/00* (2006.01)

(52) U.S. Cl.
USPC ..... 415/116; 415/173.1

(58) Field of Classification Search
CPC ..... F01D 11/00; F01D 11/08; F01D 11/24; F01D 25/24; F01D 25/28; F01D 9/023; F05B 2240/11
USPC ..... 415/115, 116, 117, 214.1, 196, 197, 415/173.1, 173.4, 174.4, 134, 139
See application file for complete search history.

(56) References Cited

U.S. PATENT DOCUMENTS 4,303,371 A 12/1981 Eckert
4,573,865 A 3/1986 Hsia et al.
4,650,394 A 3/1987 Weidner
4,650,395 A 3/1987 Weidner
4,752,184 A 6/1988 Liang
5,092,735 A 3/1992 Katy et al.
5,127,793 A 7/1992 Walker et al.
5,165,847 A 11/1992 Proctor et al.
5,169,287 A 12/1992 Proctor et al.
5,197,853 A 3/1993 Creevy et al.
5,374,161 A 12/1994 Kelch et al.
5,375,973 A 12/1994 Sloop et al.
5,380,150 A 1/1995 Stahl
5,423,659 A 6/1995 Thompson
5,480,281 A 1/1996 Correia
5,486,090 A 1/1996 Thompson et al.
5,538,393 A 7/1996 Thompson et al.
5,584,651 A 12/1996 Pietraszkiewicz et al.
5,586,859 A 12/1996 Nolcheff
5,609,469 A 3/1997 Worley et al.
5,639,210 A 6/1997 Carpenter et al.
5,649,806 A 7/1997 Scricca et al.
5,988,975 A 11/1999 Pizzi
5,993,150 A 11/1999 Liotta et al.
6,126,389 A 10/2000 Burdgick
6,139,257 A 10/2000 Proctor et al.
6,146,091 A 11/2000 Watanabe et al.

(Continued)

*Primary Examiner* — Edward Look
*Assistant Examiner* — Christopher J Hargitt
(74) *Attorney, Agent, or Firm* — Norton Rose Fulbright Canada LLP

(57) ABSTRACT

A blade outer air seal (BOAS) segment has a plurality of cooling passages axially extending through a platform of the BOAS segment. The passages each have an inlet defined in a radially outer surface and an exit defined on a leading edge of the platform. At least one of the passages positioned close to respective circumferential sides of the platform extends linearly from one of the inlets and is skewed away from the axial direction to cool a corner area of the platform.

9 Claims, 13 Drawing Sheets

(56) References Cited

U.S. PATENT DOCUMENTS

| | | | | |
|---|---|---|---|---|
| 6,393,331 | B1 | 5/2002 | Chetta et al. | |
| 6,508,623 | B1 | 1/2003 | Shiozaki et al. | |
| 6,779,597 | B2 | 8/2004 | DeMarche et al. | |
| 6,814,538 | B2 | 11/2004 | Thompson | |
| 6,877,952 | B2 | 4/2005 | Wilson | |
| 7,033,138 | B2 | 4/2006 | Tomita et al. | |
| 7,063,503 | B2 | 6/2006 | Meisels | |
| 7,165,937 | B2 | 1/2007 | Dong et al. | |
| 7,201,559 | B2 | 4/2007 | Gendraud et al. | |
| 7,210,899 | B2 | 5/2007 | Wilson, Jr. | |
| 7,293,957 | B2 | 11/2007 | Ellis et al. | |
| 7,306,424 | B2 | 12/2007 | Romanov et al. | |
| 7,334,985 | B2 | 2/2008 | Lutjen et al. | |
| 7,338,253 | B2 | 3/2008 | Nigmatulin | |
| 7,513,040 | B2 | 4/2009 | Cunha et al. | |
| 7,520,715 | B2 * | 4/2009 | Durocher et al. | 415/116 |
| 7,524,163 | B2 | 4/2009 | Self et al. | |
| 7,553,128 | B2 | 6/2009 | Abdel-Messeh et al. | |
| 7,597,533 | B1 | 10/2009 | Liang | |
| 7,600,967 | B2 * | 10/2009 | Pezzetti et al. | 415/173.1 |
| 7,621,719 | B2 | 11/2009 | Lutjen et al. | |
| 7,665,955 | B2 | 2/2010 | Liang | |
| 7,665,961 | B2 | 2/2010 | Lutjen et al. | |
| 7,665,962 | B1 | 2/2010 | Liang | |
| 7,670,108 | B2 * | 3/2010 | Liang | 415/173.1 |
| 7,704,039 | B1 | 4/2010 | Liang | |
| 2004/0141838 | A1 | 7/2004 | Thompson | |
| 2005/0232752 | A1 | 10/2005 | Meisels | |
| 2007/0020088 | A1 * | 1/2007 | Durocher et al. | 415/115 |
| 2008/0118346 | A1 | 5/2008 | Liang | |
| 2009/0067994 | A1 | 3/2009 | Pietraszkiewicz et al. | |
| 2009/0087306 | A1 | 4/2009 | Tholen et al. | |
| 2009/0096174 | A1 | 4/2009 | Spangler et al. | |
| 2009/0169368 | A1 | 7/2009 | Schlichting et al. | |
| 2009/0214329 | A1 | 8/2009 | Joe et al. | |

* cited by examiner

BLADE OUTER AIR SEAL COOLING

CROSS-REFERENCE TO RELATED APPLICATIONS

This application claims the benefit of priority from U.S. Provisional Patent Application No. 61/234,849 entitled BLADE OUTER AIR SEAL filed on Aug. 18, 2009, which is incorporated herein by reference.

TECHNICAL FIELD

The described subject matter relates generally to gas turbine engines and more particularly, to a blade outer air seal of gas turbine engines.

BACKGROUND

A typical gas turbine engine includes a fan, compressor, combustor and turbine disposed along a common longitudinal axis. In most cases, the turbine includes several stages, each having a rotor assembly and at least one stationary vane assembly located forward and/or aft of the rotor assembly to guide the hot gas flow entering and/or exiting the rotor assemblies. Each rotor assembly includes a static turbine shroud around the turbine rotor to form a blade outer air seal (BOAS) in order to guide the hot gas flow passing through the turbine rotor. The turbine shroud is supported by a support structure within a core case of the engine. The BOAS works in the hot section of the engine and is subject to elevated temperatures. Therefore, efforts have been made to improve the BOAS configuration in order to limit and/or properly transfer loads caused by dissimilar thermal expansion within the engine, thereby providing an axially straight tip clearance above the blades of the turbine rotor and maintaining appropriate tip clearance of the turbine blades, which has a significant affect on engine performance. The efforts for improving the BOAS involve both a load transfer issue and a cooling issue of the BOAS.

Accordingly, there is a need to provide an improved BOAS.

SUMMARY

In one aspect, the described subject matter provides a blade outer air seal assembly of a gas turbine engine having a main axis of rotation defining axial, radial and circumferential directions, the blade outer air seal assembly comprising an array of circumferentially adjoining blade outer air seal support segments forming a support ring; and an array of circumferentially adjoining blade outer air seal segments forming a static turbine shroud surrounding a turbine rotor, the turbine shroud being supported within the support ring, the blade outer air seal segments each including a platform extending axially from a leading edge to a trailing edge and circumferentially between opposed circumferential sides of the platform, front and rear hooks to support the platform radially and inwardly spaced apart from the support ring, to thereby define an annular cavity between the front and rear hooks, the platform defining a plurality of cooling passages extending axially through the platform, each of the cooling passages having an inlet defined in a radially outer surface of the platform and an exit defined on the leading edge, each inlet communicating with the annular cavity for intake of cooling air from the annular cavity, and wherein at least one of said cooling passages positioned close to the respective opposed circumferential sides extends linearly from one of the inlets and is skewed away from the axial direction in order to cool a corner area of the platform between the leading edge and the respective opposed circumferential sides.

In another aspect, the described subject matter provides a blade outer air seal segment of a blade outer air seal assembly of a gas turbine engine having a main axis of rotation defining axial, radial and circumferential directions, the blade outer air seal segment comprising a platform extending axially from a leading edge to a trailing edge and circumferentially between opposed circumferential sides of the platform, the platform defining a seal slot positioned in the respective opposed circumferential sides and extending from a leading edge area toward the trailing edge and defining a plurality of cooling passages extending axially through the platform and exiting at the leading edge, the platform further defining a plurality of cavities in a radially outer surface of the platform, each cavity communicating with one of the passages to form an inlet with an enlarged diameter with respect to said one passage, wherein at least one of said cooling passages positioned close to the respective opposed circumferential sides extends linearly from one of the inlets and is skewed away from the axial direction in order to cool corner area of the platform between the leading edge and the respective opposed circumferential sides while avoiding interference with the respective seal slots.

Further details of these and other aspects of the present invention will be apparent from the detailed description and figures included below.

DESCRIPTION OF THE DRAWINGS

Reference is now made to the accompanying drawings depicting aspects of described subject matter, in which.

DETAILED DESCRIPTION

Figure 1:
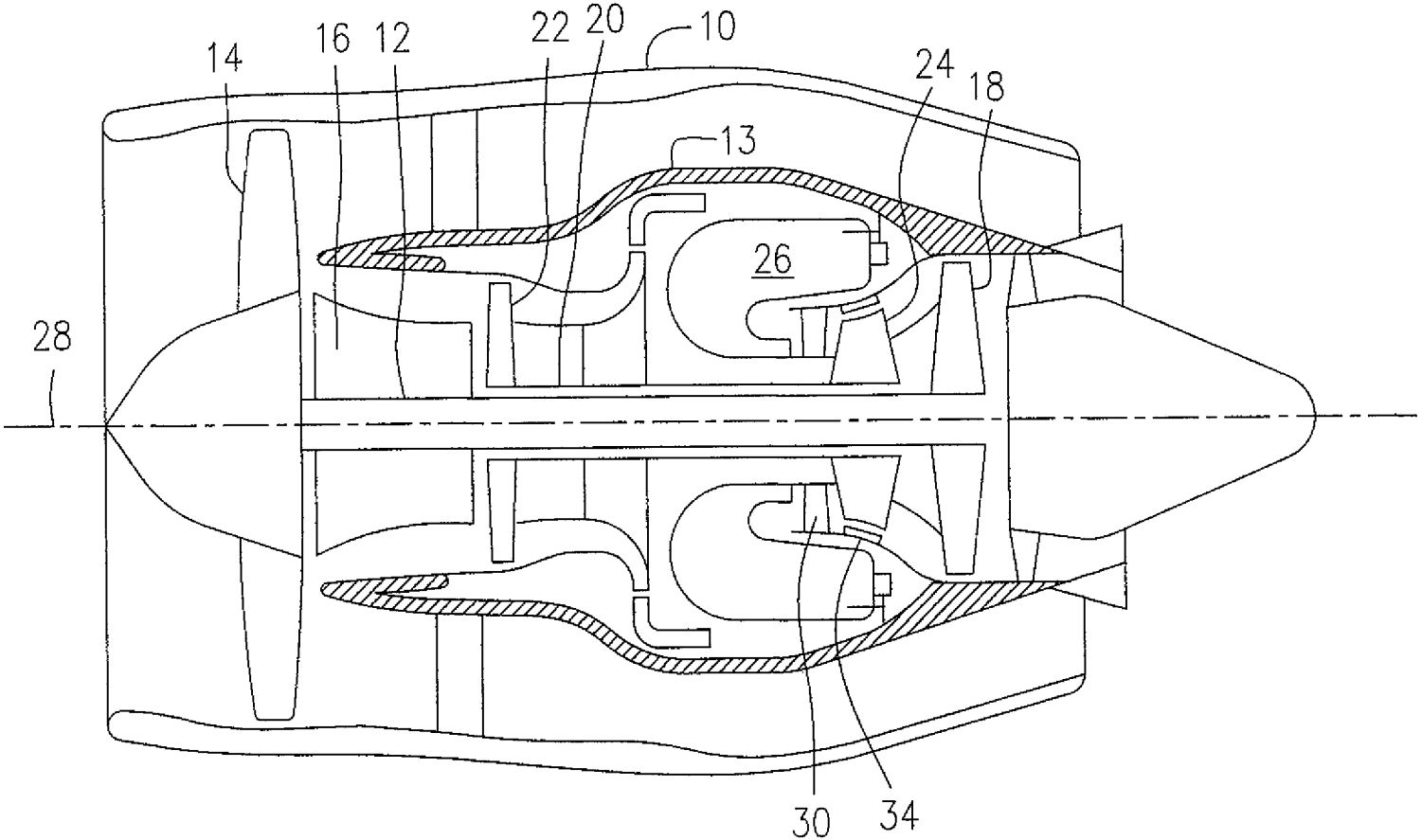
FIG. 1 is a schematic cross-sectional view of a turbofan gas turbine engine as an example of the application of the described subject matter, schematically illustrating a blade outer air seal (BOAS) assembly around a turbine of the engine.

FIG. 1 schematically illustrates a turbofan gas turbine engine which includes a nacelle configuration 10, a core casing 13, a low pressure spool assembly seen generally at 12 which includes a fan assembly 14, a low pressure compressor assembly 16 and a low pressure turbine assembly 18, and a high pressure spool assembly seen generally at 20 which includes a high pressure compressor assembly 22 and a high pressure turbine assembly 24. The core casing 13 surrounds the low and high pressure spool assemblies 12 and 20 in order to define a main fluid path (not indicated) therethrough. In the main fluid path there is provided a combustion chamber 26 in which a combustion process takes place, producing combustion gases for powering the high and low pressure turbine assemblies 24, and 18. The engine has a main axis 28 of rotation and therefore, axial, radial and circumferential/tangential directions mentioned in this description and appended claims are defined with respect to this axis 28.

Figure 2:
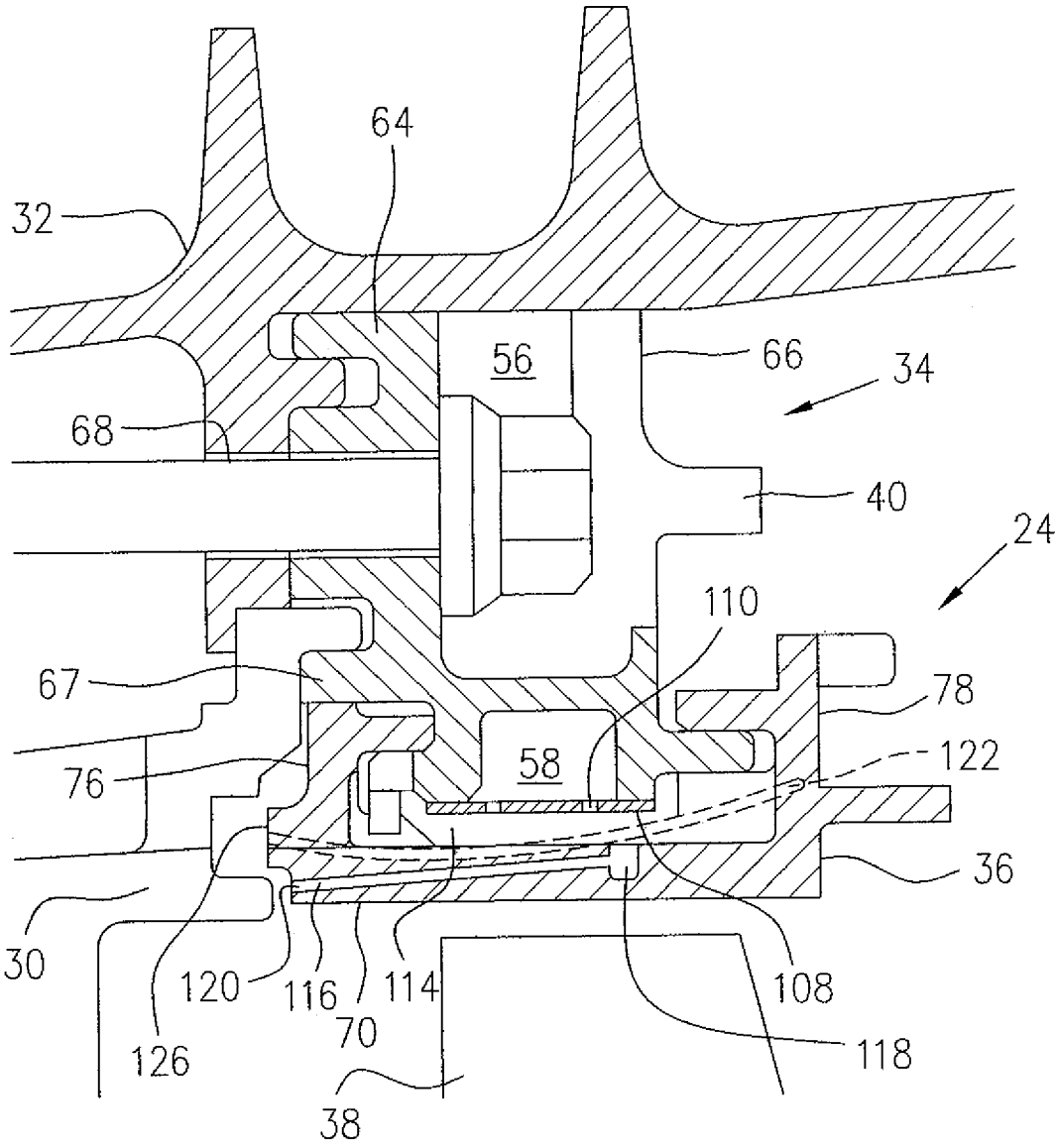
FIG. 2 is a partial cross-sectional view of the gas turbine engine of FIG. 1, showing the structural configuration of the BOAS assembly according to one embodiment.

Referring to FIGS. 1 and 2, the engine further includes a static vane ring assembly 30 axially positioned between the combustion chamber 26 and a turbine assembly, for example the high pressure turbine assembly 24 for directing combustion gases from the combustion chamber 26 to pass through the high pressure turbine assembly 24. The vane ring assembly 30 and the high pressure turbine assembly 24 are both supported within an outer case 32 which may be part of the core casing 13. The turbine assembly 24 includes a blade outer air seal (BOAS) assembly 34 having an array of circumferentially adjoining BOAS segments 36 (only one shown) forming a static turbine shroud (not indicated) surrounding a turbine rotor 38. The BOAS assembly 34 further includes an array of circumferentially adjoining BOAS support segments 40 (only one shown) forming a static support ring (not indicated) around the array of BOAS segments 36.

Figure 3:
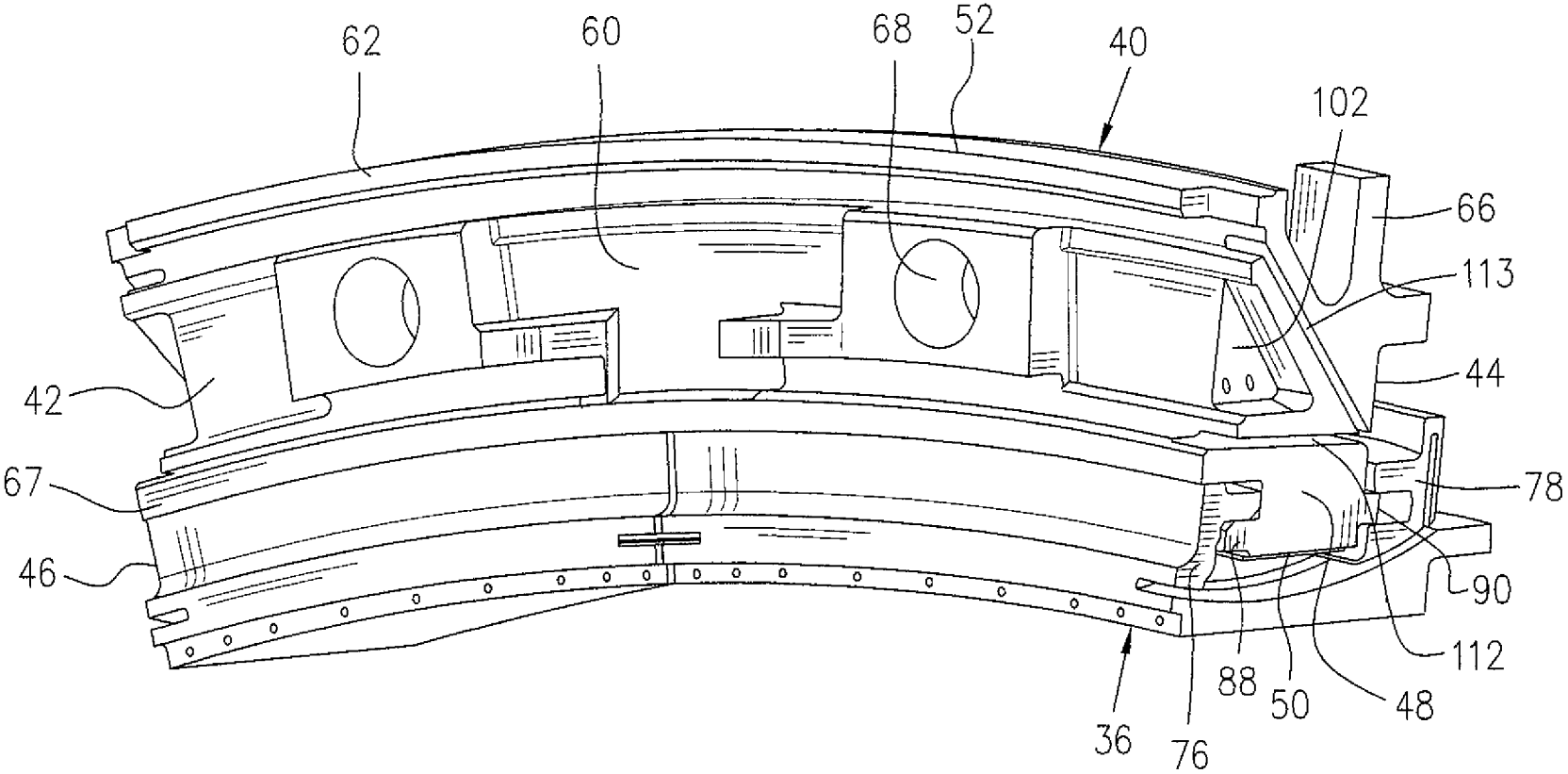
FIG. 3 is a partial perspective view of the BOAS assembly of FIG. 2, showing a pair of BOAS segments supported by a BOAS support segment.

Referring to FIGS. 2-6, each of the BOAS support segments 40 has a forward end 42 (upstream end) and a rearward end 44 (downstream end) with respect to the gas flow passing through the turbines, opposed circumferential sides 46, 48, a radially inner side 50 and radially outer side 52. The one or more BOAS segments 36 are connected to the radially inner side 50 of the BOAS support segment 40. A pair of BOAS segments 36 is connected to one BOAS support segment 40, according to this embodiment as shown in FIG. 3. The radially outer side 52 provides a radially outwardly abutting surface (not indicated) to support the support ring formed by the BOAS support segments 40, within the outer case 32.

The BOAS support segment 40 has a hollow configuration and may include a circumferential wall 54 (see FIGS. 5 and 6) extending between the forward and rearward ends 42, 44 and between the opposed circumferential sides 46, 48 to define an inner space 56 (see FIG. 6) at a radial and outward portion of the BOAS support segment 40. The inner space 56 is substantially open at both the radially outer side 52 and at the rearward end 44 of the BOAS support segment 40. The circumferential wall 54 also defines a cavity 58 (see FIGS. 2 and 5) at a radial and inner portion of the BOAS support segment 40. The cavity 58 defines an opening (not indicated) at the radially inner side 50 of the BOAS support segment 40. A radial wall 60 is positioned at the forward end 42 and extends circumferentially between the opposed circumferential sides 46, 48. A circumferential flange segment 62 extends axially forwardly from a radially outer end of the circumferentially extending radial wall 60 to thereby in combination with the radial wall 60, form a front leg 64 (only indicated in FIG. 2) having an inverted L-shaped cross-section, for engagement with the outer case 32.

A pair of radially and outwardly extending elongated rear prongs 66 are positioned axially at the rearward end 44 and circumferentially at the respective opposed circumferential sides 46, 48, of the BOAS support segment 40. Each of the rear prongs 66 provides a surface at its radially outer end to radially and outwardly abut the outer case 32. The two rear prongs 66 are circumferentially spaced apart, therefore the space 56 within the support segment 40 is conveniently accessible from an open area (not indicated) between the two rear prongs 66, even when the BOAS support segment 40 is assembled in the BOAS assembly 34 and installed in the outer case 32, as shown in FIG. 2.

The BOAS support segment 40 further includes a circumferential flange segment 67 extending axially forwardly from the forward end 42 at a location near the radially inner side 50 of the BOAS support segment 40, to provide a radial surface (not indicated) which may be in contact with the static vane ring assembly 30, for receiving an axial load from an adjacent component of the static vane ring assembly 30. This axial load, acting on a location of the support segment 40 near the radially inner side 50 creates a moment of force in an anticlockwise direction about the radially outer end of the front leg 64 (see FIG. 2). This moment of force could cause a rocking motion of the BOAS support segment 40 in the same direction, if not properly transferred to the outer case 32. The rear prongs 66 provide an adequate load transfer link such that the moment of force created by vane loads acting axially on the circumferential flange segment 67 is properly transferred by the rear prongs 66 in a radially outward direction, to the outer case 32, thereby preventing the rocking motion of the BOAS support segment 40 from being transferred to the BOAS segment 36, and thereby contributing to maintaining an axially straight tip clearance around the turbine rotor 38.

The rear prongs 66 also properly transfer other loads, such as radial thermal expansion loads of the turbine shroud formed with the BOAS segment 36. However, the rear prongs 66 do not axially and circumferentially engage with the outer case 32. The BOAS support segments 40 are allowed for axial and/or circumferential thermal expansion within a limited tolerance The radial wall 60 is provided with one or more apertures 68 for receiving fasteners (not indicated) extending axially through the radial wall 60 and into the inner space 56, as shown in FIG. 2. The fasteners are used to secure the front leg 64 to a radial wall (not indicated) of the outer case 32 in order to secure the entire BOAS assembly 34 to the outer case 32. In this embodiment, two apertures 68 are circumferentially spaced apart. The fasteners received in the apertures 68 are conveniently accessible from the rearward end 44 through the open area between the pair of rear prongs 66. A radial central wall 55 may be provided (see FIG. 6) extending axially from the radial wall 60 across the inner space 56 to divide the same into two circumferential portions, each accommodating one of the fasteners.

Figure 13:
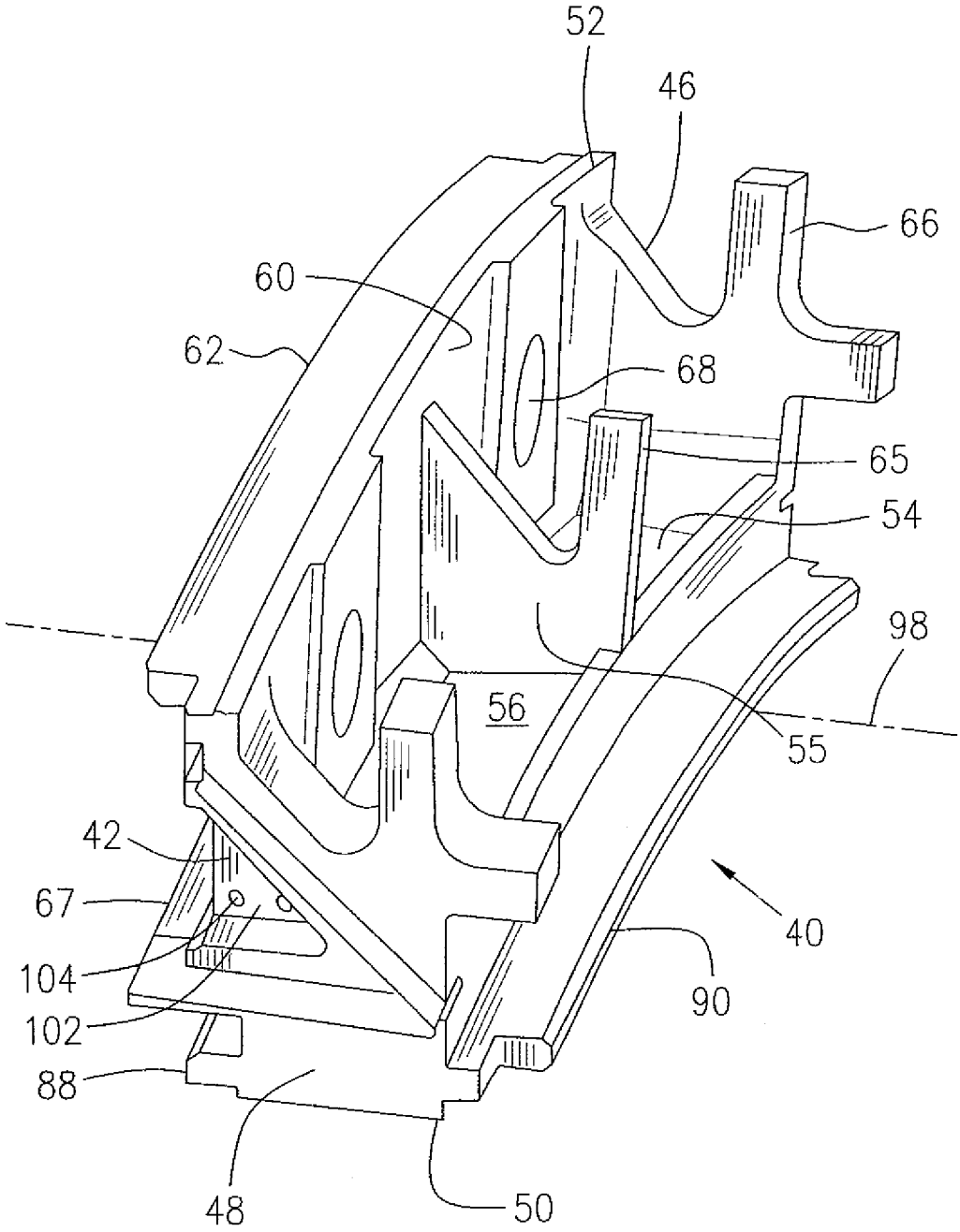
FIG. 13 is a perspective view of the BOAS support segment similar to that of FIG. 6, optionally having an additional middle rear prong, according to another embodiment.

As shown in FIG. 13, the BOAS support segment 40 according another embodiment may optionally include additional rear prongs, for example such as an additional middle prong 65 at the rearward end 44 of the BOAS support segment 40, circumferentially located between the pair of rear prongs 66 at the opposed circumferential sides 46, 48. Other structures and features are similar to those shown in FIG. 6, and are indicated by the same numerals. It is understood that the fasteners received in the respective apertures 68 are still accessible from the rearward end 44 of the BOAS support segment 40 because the apertures 68 are circumferentially aligned with the open areas between the middle rear prong 65 and the respective rear prongs 66 at the opposed circumferential sides 46, 48 of the BOAS support segment 40.

Figure 8:
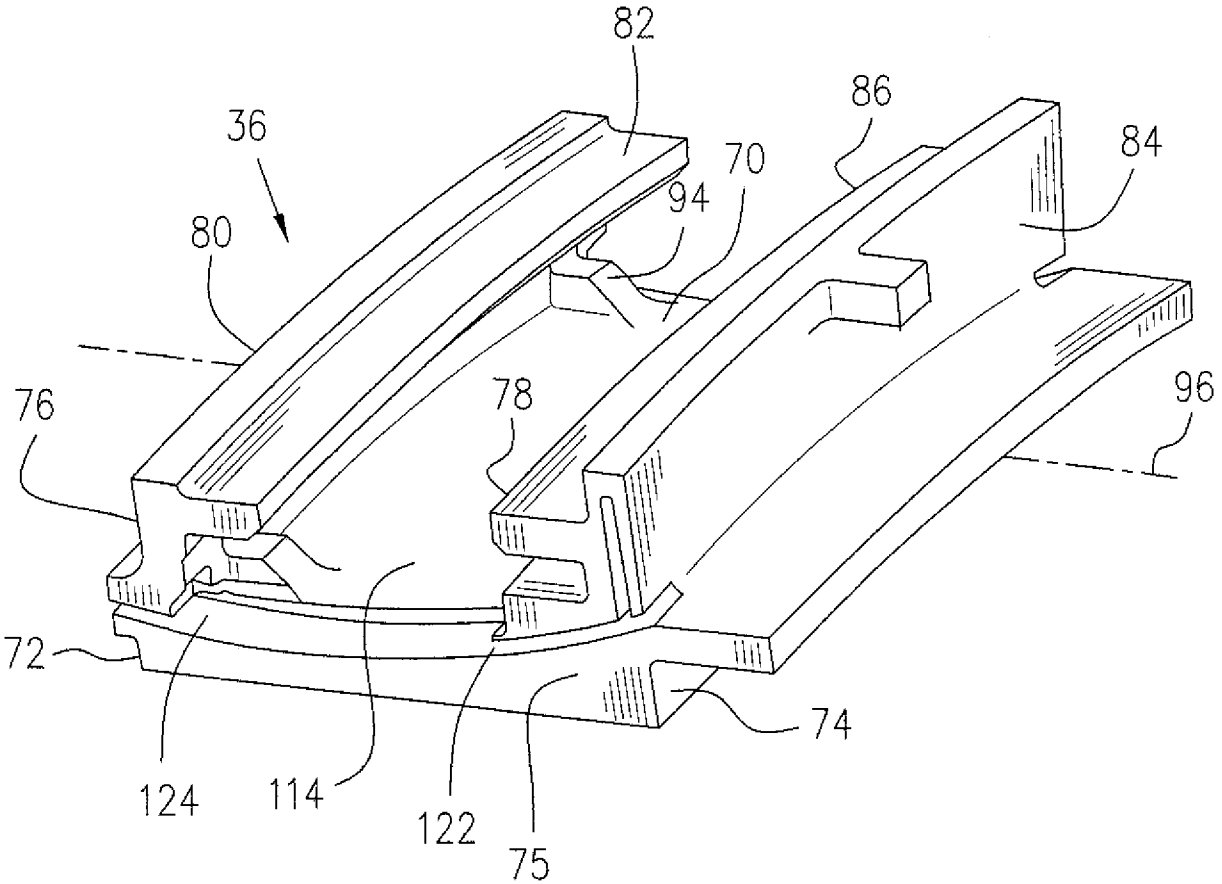
FIG. 8 is a perspective view of the BOAS segment in the BOAS assembly of FIG. 3, showing a pair of cast anti-rotation tabs integrated with the BOAS segment.

Referring to FIGS. 2 and 8, each of the BOAS segments 36 includes a platform 70 extending axially from a leading edge 72 to a trailing edge 74 (with respect to the gas flow direction in the engine) and circumferentially extending between opposed circumferential sides 75, and further includes front and rear hooks 76 and 78 integrated with the platform 70 to support the platform 70, radially and inwardly spaced apart from the support ring formed by the BOAS support segments 40. The front hook 76 includes a radial wall 80 circumferentially extending between the opposed circumferential sides 75 and a circumferential flange segment 82 extending radially rearwardly from a radially outer end of the radial wall 80, thereby forming the front hook 76 in an inverted L-shape. The rear hook 78 includes a radial wall 84 circumferentially extending between the opposed circumferential sides 75 and axially spaced apart from the radial wall 80, and a circumferential flange segment 86 extending axially forwardly from the radial wall 84, thereby forming the rear hook 78 in an inverted L-shape. The front and rear hooks 76 and 78 in combination form an engaging device for connection with the BOAS support segment 40.

Referring to FIGS. 2-4 and 8-9, the BOAS support segment 40 according to this embodiment may be provided with a complementary engaging device for radial and axial engagement with the front and rear hooks 76, 78 of the BOAS segments 36. The complementary engaging device of the BOAS support segment 40 according to this embodiment, may include at least one circumferentially extending front engaging element 88 projecting axially and forwardly from the BOAS support segment 40 near the radially inner side 50, and a circumferentially extending rear engaging element 90 projecting axially and rearwardly from the BOAS support segment 40 near the radially inner side 50. The front and rear engaging elements 88, 90 radially and axially engage the respective front and rear hooks 76, 78 of the BOAS segment 36 and allow a circumferential movement of the BOAS segment 36 relative to the BOAS support segment 40 such that the BOAS segment 36 can be circumferentially slid from one of the opposed circumferential sides 46, 48 of the BOAS support segment 40 into a predetermined circumferential position, while maintaining connection with the BOAS support segment 40.

An anti-rotation apparatus is provided for restricting relative circumferential movement between the turbine shroud formed by the BOAS segments 36 and the support ring formed by the BOAS support segments 40. The anti-rotation apparatus may include a stopper 92 (see FIG. 9) provided at least in one of the BOAS support segments 40 and at least one cast anti-rotation tab 94 integrated with one of the BOAS segments 36 supported on the at least one BOAS support segments 40. The stopper 92 and the cast anti-rotation tab 94 circumferentially abut each other. Those BOAS support segments having no stoppers will be circumferentially restricted by those having stoppers. Those BOAS segments having no cast anti-rotation tabs will be circumferentially restricted by those having the cast anti-rotation tabs.

In this embodiment, each of the BOAS support segments 40 supports a pair of the BOAS segments 36, and the anti-rotation apparatus may include at least one stopper 92 provided on each of the BOAS support segments 36 and at least one cast anti-rotation tab 94 integrated with each of the BOAS segments 36. The stopper 92 of each of the BOAS support segments 40, defines circumferentially opposed side surfaces for abutting the at least one cast anti-rotation tab 94 of the respective BOAS segments 36 supported on the BOAS support segment 40. Therefore, every BOAS segment 36 and every BOAS support segment 40 is circumferentially restricted with their own cast anti-rotation tab 94 and the stoppers 92. The anti-rotation tolerance between the BOAS support segment 40 and the pair of BOAS segments 36 supported thereon is therefore more controllable.

Figure 4:
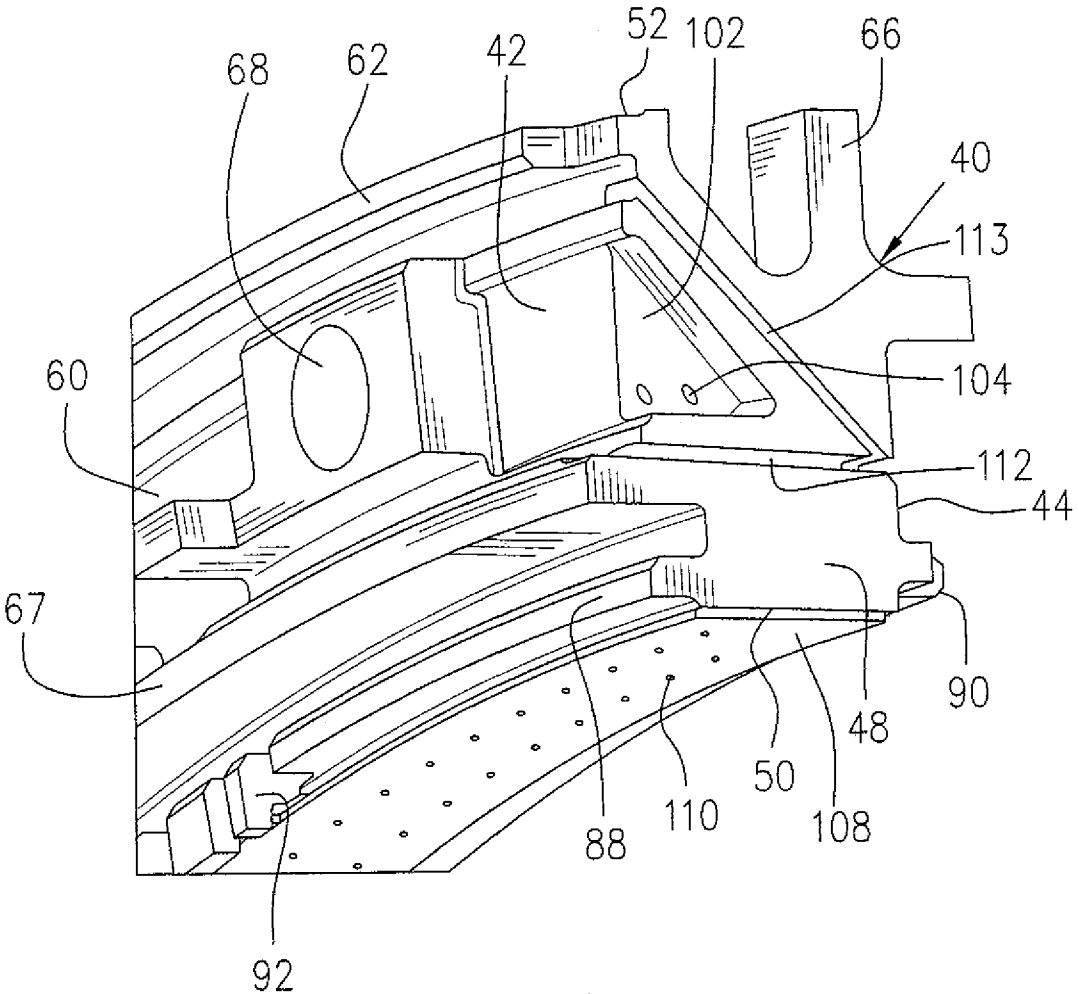
FIG. 4 is a partial perspective view of the BOAS support segment of FIG. 3, showing an impingement baffle plate attached to the radially inner side of the BOAS support segment.
Figure 5:
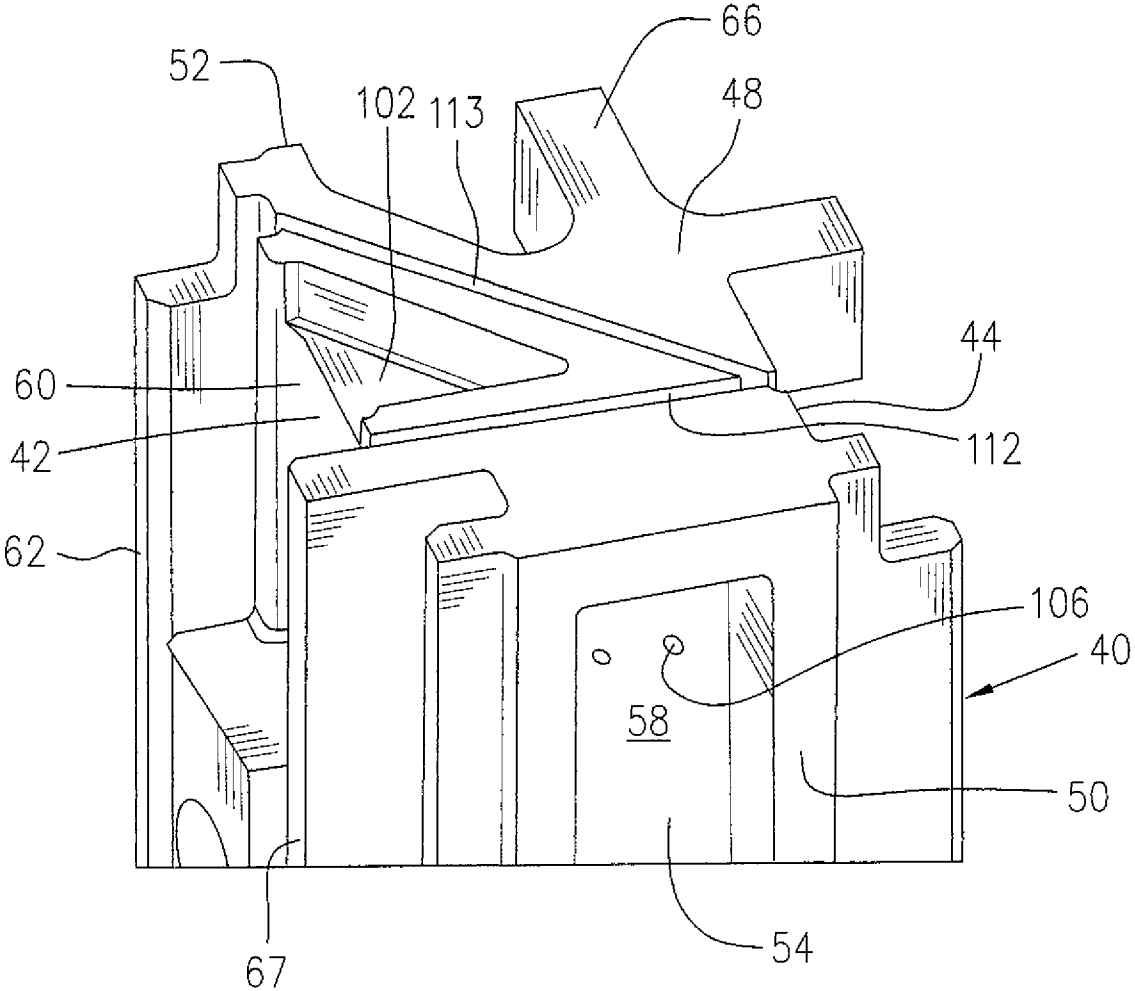
FIG. 5 is a partial perspective view of the BOAS support segment of FIG. 3, with the impingement buffer plate removed to show a dump plenum within the BOAS support segment.
Figure 6:
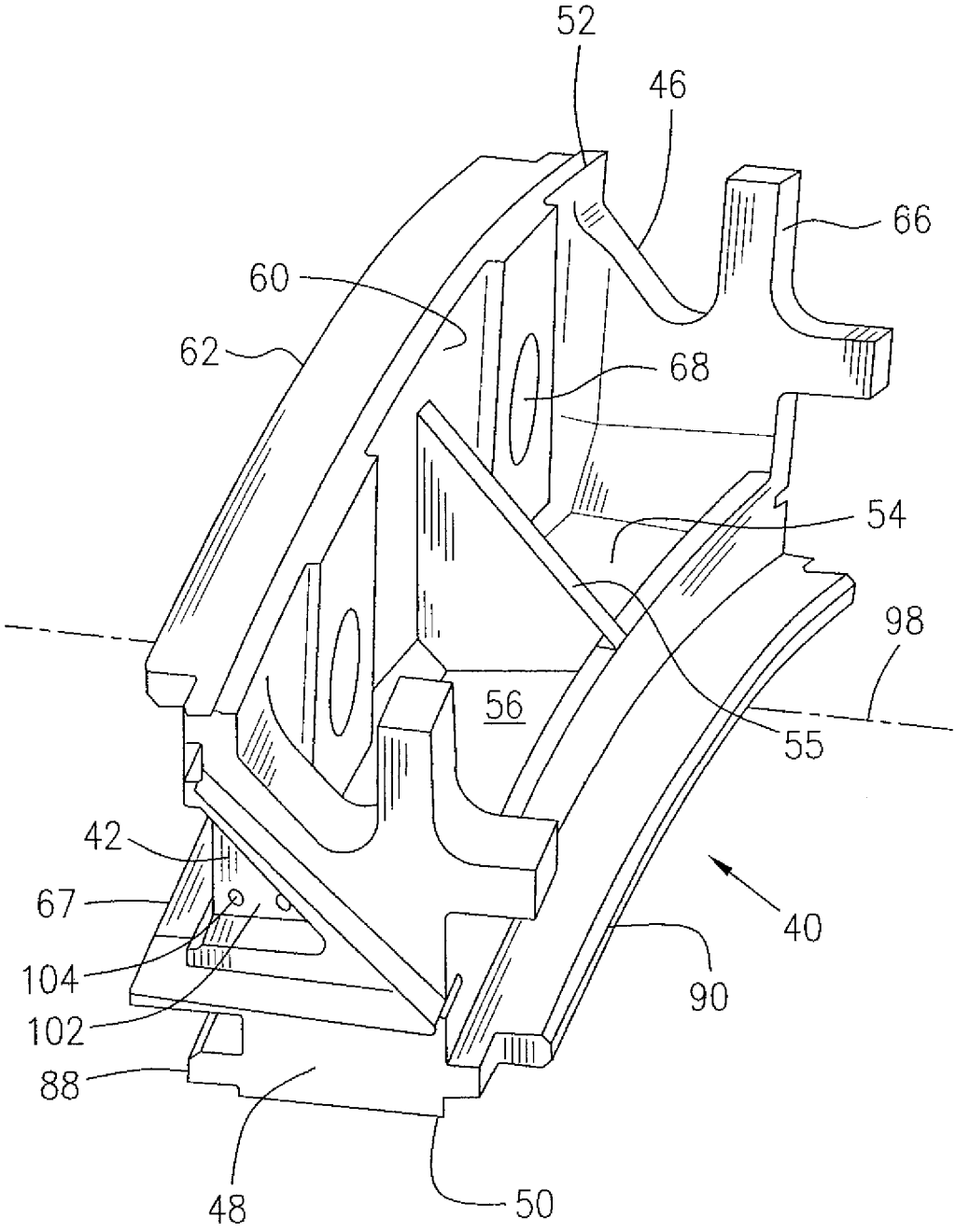
FIG. 6 is a perspective view of the BOAS support segment of FIG. 3, showing a circumferentially extending radial wall at a forward end and a pair of circumferentially spaced and radially elongated rear prongs at a rearward end of the BOAS support segment.
Figure 7:
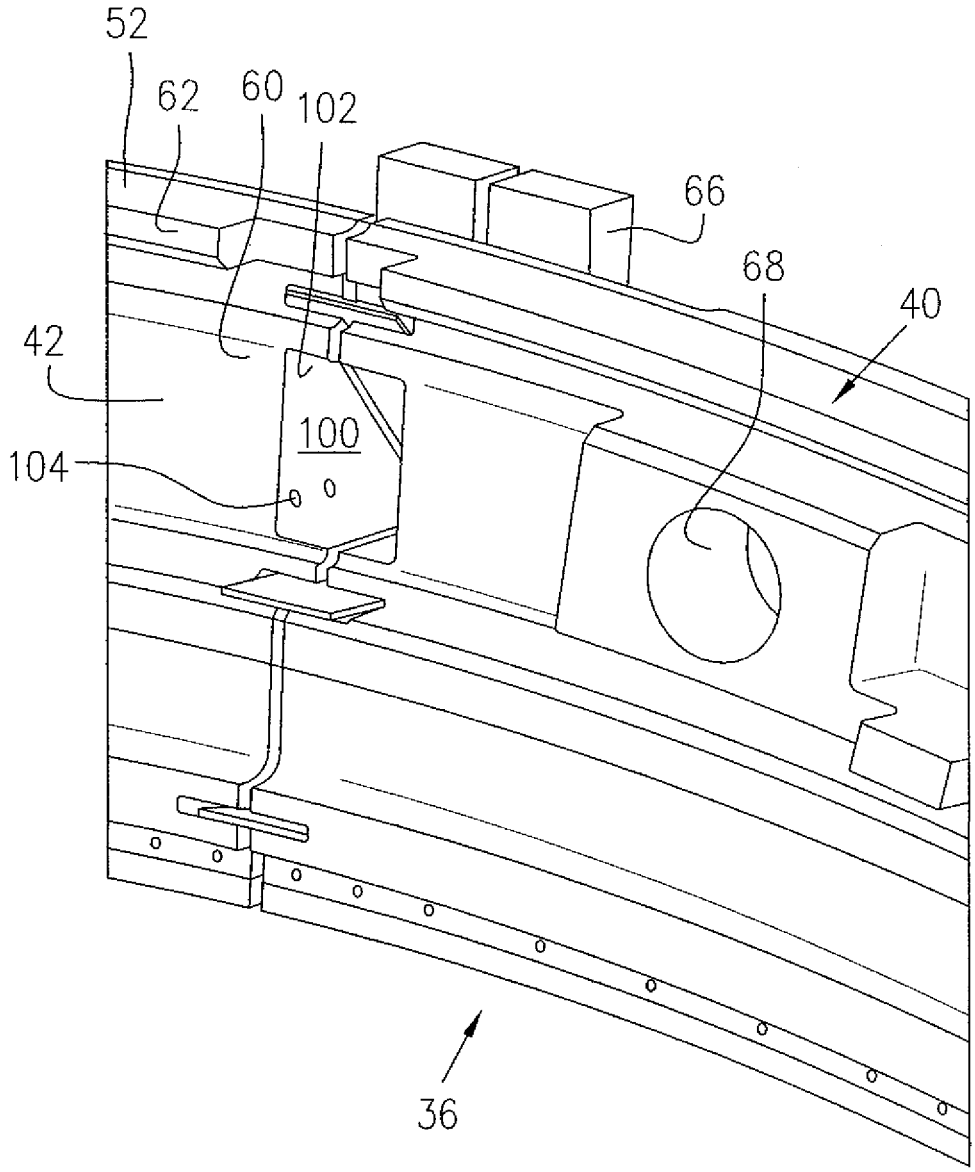
FIG. 7 is a partial perspective view of the BOAS assembly of FIG. 2, showing one of inlet cavities of a cooling air distribution system in a segmented support ring of the BOAS assembly.
Figure 9:
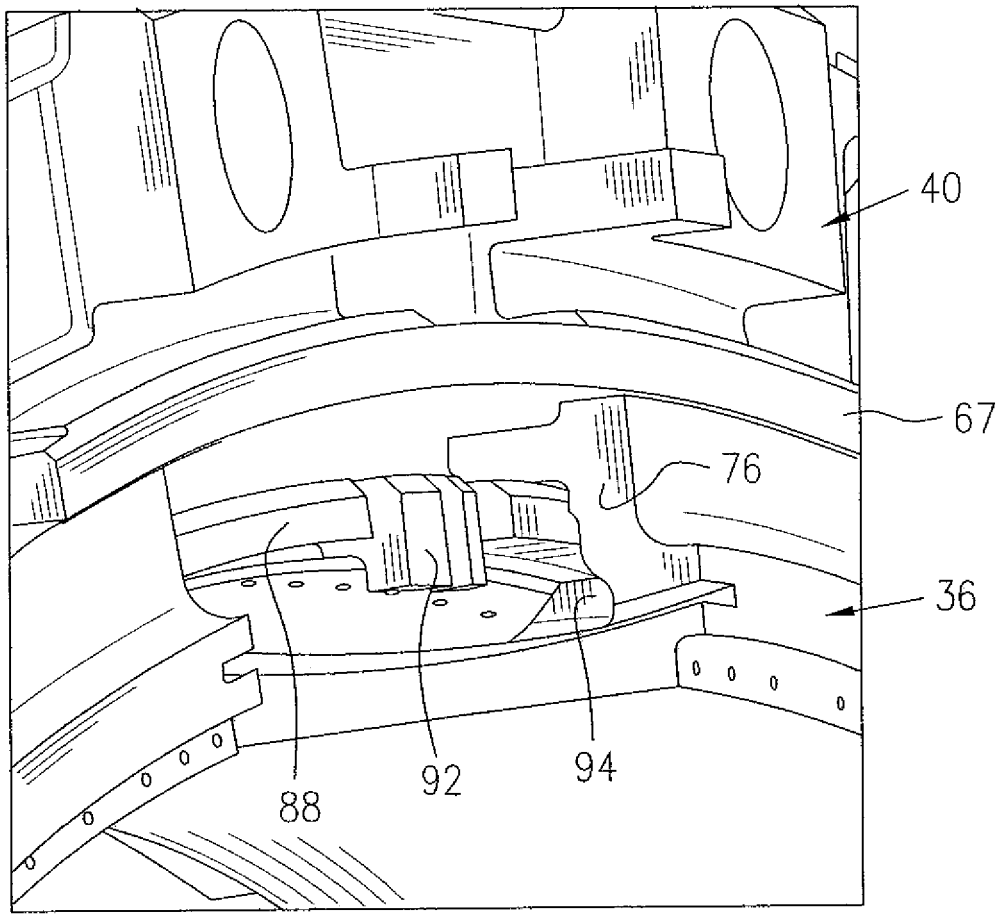
FIG. 9 is a partial perspective view of the BOAS assembly of FIG. 2 with the paired BOAS segments circumferentially slid away from each other, to show a pair of stoppers attached to the BOAS support segment.
Figure 10:
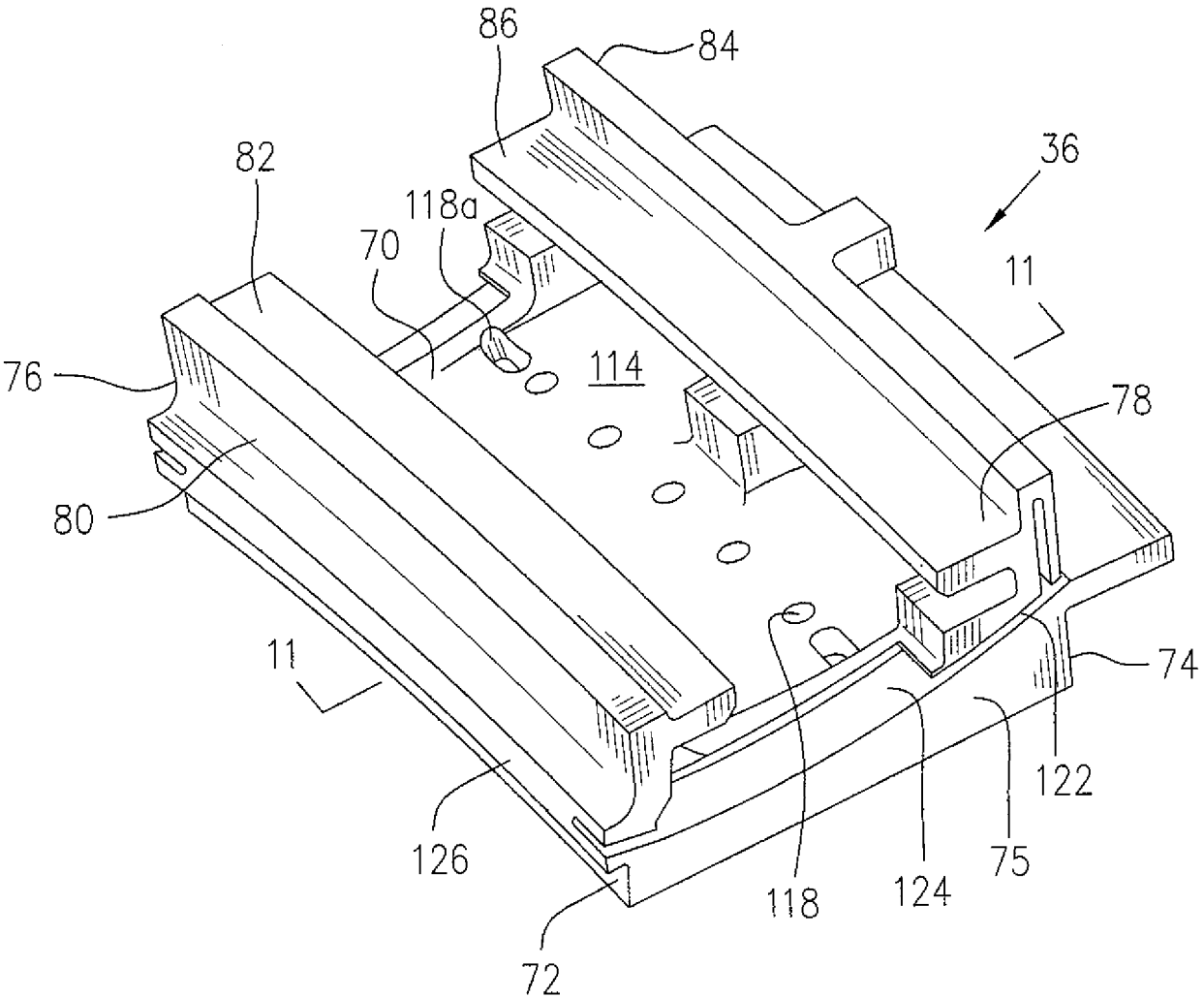
FIG. 10 is a perspective view of the BOAS segment in the BOAS assembly of FIG. 3 according to another embodiment, showing a plurality of cavities defined in the platform of the BOAS segment to form bucket inlets of cooling passages in the BOAS segment.
Figure 11:
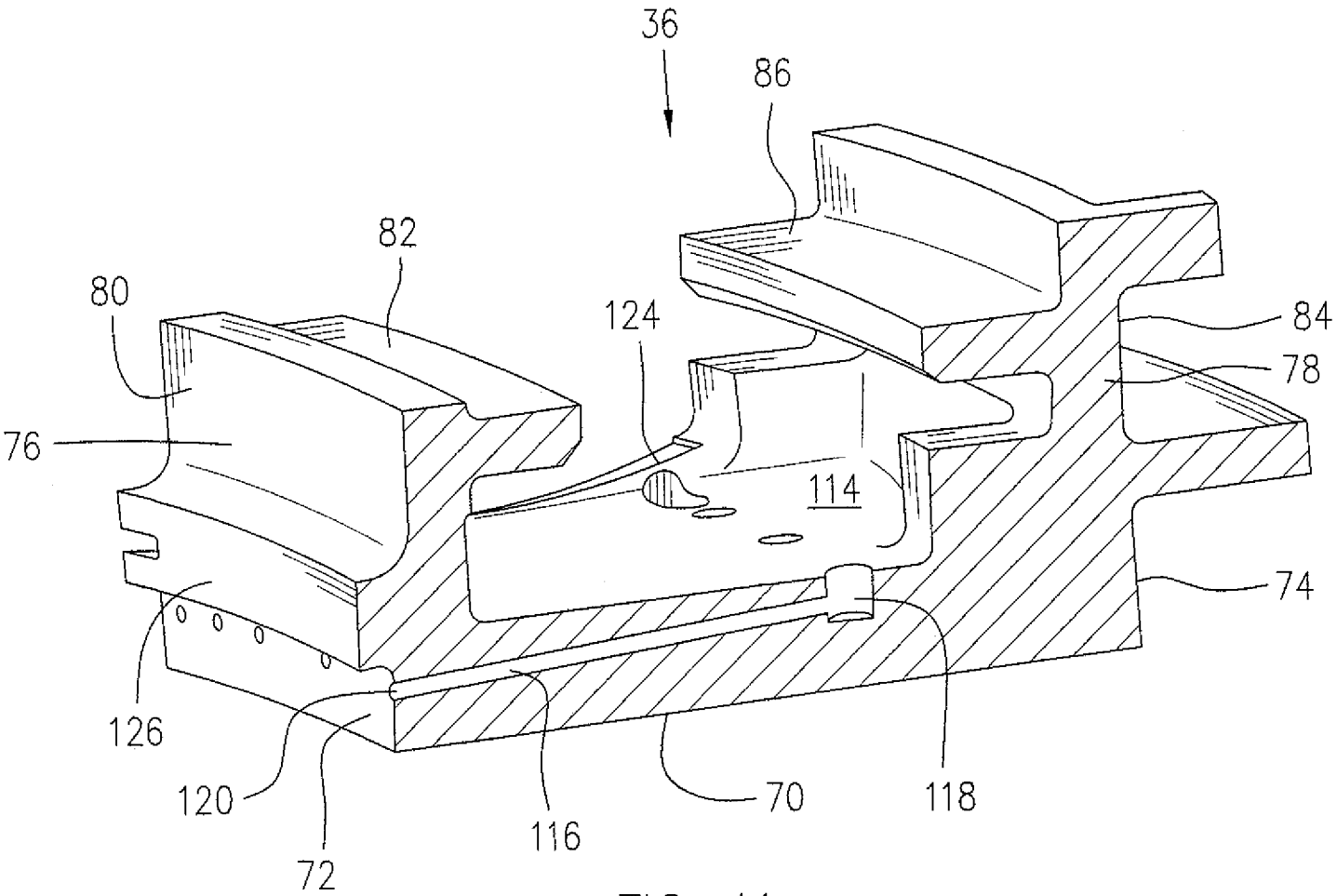
FIG. 11 is a partial perspective view of the BOAS segment of FIG. 10 with half of the segment cut away along line 11-11 in FIG. 10, to shown a cross-section thereof having the cooling passage defined therein.
Figure 12:
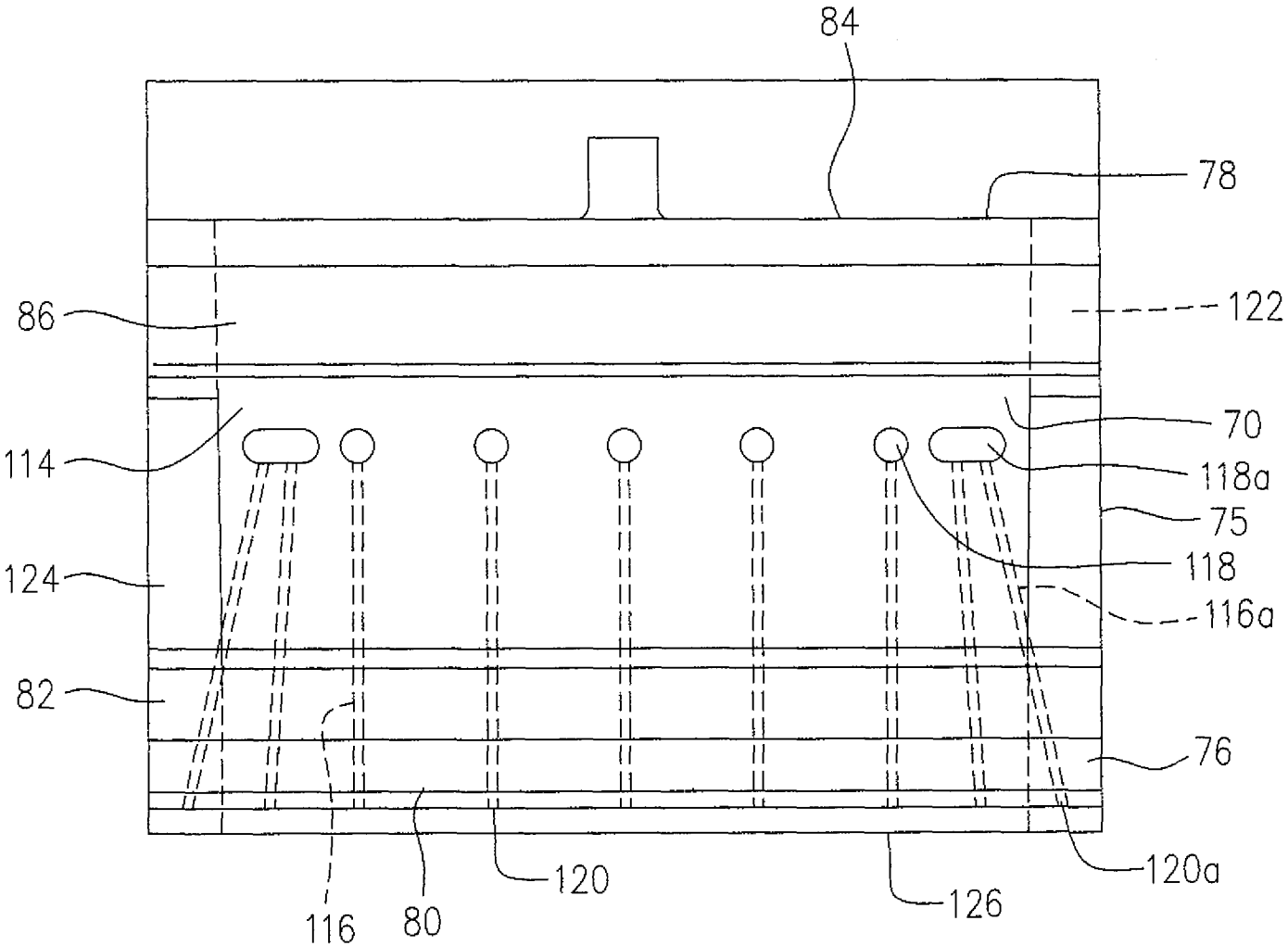
FIG. 12 is a top plan view of the BOAS segment of FIG. 10, showing the layout of the plurality of cooling passages extending through the platform of the segment.

As shown in FIGS. 4 and 8-9, two stoppers 92 and two cast anti-rotation tabs 94 may be provided to the respective BOAS support segment 40 and the BOAS segment 36 and casting process of the BOAS segment 36. The cast anti-rotation tab 94 may be positioned in an inner corner of each BOAS segment 36 and integrated with both the front hook 76 and the platform 70 of the BOAS segments 36. The stoppers 92 may be attached to a forward end 42 near the radially inner side 50 of the BOAS support segment 40. The two stoppers 92 may be a machined component which is attached for example to a circumferentially middle area of the BOAS segment 40 between two front engaging elements 88, by fasteners (not shown). The machined stoppers 92 may be circumferentially spaced apart from each other and the space therebetween may be slightly adjustable. The respective stoppers 92 define abutting surfaces circumferentially facing away from each other to abut one cast anti-rotation tab 94 of the respective BOAS segments 36 which are circumferentially slid into position from the opposed circumferential sides 48 of the BOAS support segment 40.

The two cast anti-rotation tabs 94 of each BOAS segment 36 are circumferentially spaced apart one from another and are circumferentially symmetric about a central axis 96 (see FIG. 8) of the BOAS segment 36. It is noted that only one of the cast anti-rotation tabs 94 of each BOAS segment 36 is in contact with a stopper 92 of the BOAS support segment 40, in order to provide the anti-rotation function. However, the symmetrically positioned two cast anti-rotation tabs 94 allow each of the BOAS segments 36 to be connected to the BOAS support segment 40 by sliding into position from either one of the opposed circumferential sides 46, 48 of the BOAS support segments 40 because the two stoppers 92 (or the at least one stopper 92 if only one stopper 92 is provided) are also circumferentially symmetrical about an axially central axis 98 (see FIG. 6) of the BOAS support segment 40. In other words, the circumferential position of the paired BOAS segments 36 supported by one BOAS support segment 40 as shown in FIG. 3, can be interchangeable with each other.

The anti-rotation apparatus formed by the stoppers 92 in each BOAS support segment 40 and the cast anti-rotation tabs 94 in each BOAS segment 36, prevents the paired BOAS segments 36 from rotating relative to the BOAS support segment 40 within an acceptable tolerance, after the BOAS assembly 24 is mounted into the outer case 32. The acceptable tolerance may be adjusted during or prior to the assembly procedure by the adjustment of the space between the two stoppers 92.

The BOAS assembly 34 defines a cooling system, particularly a cooling air distribution system within the support ring formed by the BOAS support segments 40, for intake of compressor bleed air, which distributes cooling air radially inwardly to and along the entire circumference of the static turbine shroud formed by the BOAS segments 36, to cool the same. As shown in FIGS. 2-7, the cooling air distribution system includes a plurality of inlet cavities 100 (one shown in FIG. 7) axially and inwardly extending from a forward end of the support ring formed by the BOAS support segments 40. The forward end of the support ring is defined by the forward end 42 of the BOAS support segments 40 and the inlet cavities 100 are circumferentially located at a respective adjoining area between two adjacent BOAS support segments 40.

Still referring to FIGS. 2-7, each of the inlet cavities 100 is formed with two recesses 102 defined in the respective adjacent two BOAS support segments 40. Each of the BOAS support segments 40 defines one of the two recesses 102 on the respective opposed circumferential sides 48 which for example may be formed by a cut-away portion of a corner of the BOAS support segment 40 between the forward end 42 and the opposed circumferential sides 48 thereof. Therefore, each recess 102 has openings at both the forward end 42 and the circumferential side 46 or 48 of the BOAS support segment 40. Each of the BOAS support segments 40 further includes a plurality of substantially circumferential or tangential passages 104 extending from the respective recesses 102 inwardly to the inner space 56 (see FIG. 6). The inner space 56 is in fluid communication with a damp plenum formed by the cavity 58, through a plurality of holes 106 radially extending through the circumferential wall 54 (see FIG. 5). A buffer plate 108 with a plurality of impingement holes 110 extending therethrough may be provided, to be attached to the radially inner side 50 of the BOAS support segment 40 (see FIG. 4), covering the opening of the cavity 58.

Therefore, the above-described configuration of the BOAS support segment 40 defines the cooling air distribution system for intake of compressor bleed air from the forward end of the support ring formed by the BOAS support segments 40, through the inlet cavities 100. The cooling compressor bleed air is then directed from the inlet cavities 100 through the substantially circumferential passages 104 into the inner space 56 of the respective BOAS support segments 40. In each of the BOAS support segments 40, the cooling air in the inner space 56 enters the dump plenum formed by the cavity 58 radially and inwardly through the holes 106 and then further passes through the impingement holes 110 of the buffer plate 108, to radially and inwardly impinge upon the BOAS segments 36 connected to the BOAS support segment 40.

Each of the BOAS support segments 40 according to one embodiment, may further include seal slots defined in the opposed circumferential sides 46, 48, to receive seals (shown in FIG. 7 but not indicated) to prevent cooling air leakage from a circumferential gap (not indicated) between the two recesses 102 on the respective adjacent BOAS support segments 40, which forms one inlet cavity 100. For example, each of the opposed circumferential sides 46, 48 of the BOAS support segment 40, may define a seal slot 112 extending axially from the forward end 42 to the rearward end 44 and a seal slot 113 extending radially and inwardly from the forward end 42 to the rearward end 44 and adjoining the seal slot 112 near the rearward end 44. Therefore, the recess 102 is positioned between the seal slots 112 and 113.

Referring to FIGS. 2 and 10-12, the axially spaced apart front and rear hooks 76 and 78 of the respective BOAS segments 36, support the platform 70 to be radially and inwardly spaced apart from the support ring formed by the BOAS support segments 40, thereby defining an annular cavity 114 between the front and rear hooks 76, 78. According to another embodiment, each of the BOAS segments 36 may define a plurality of cooling passages 116 extending axially through the platform 70 from individual inlet cavities 118 which are defined in a radially outer surface of the platform 70, to an exit hole 120 defined on the leading edge 72 of the platform 70. Each inlet cavity 118 may be cylindrical and may have a diameter larger than the connected cooling passage 116, and may be referred to as a "bucket" inlet for the cooling passage 116. The inlet cavity 118 is in fluid communication with the annular cavity 114 for intake of cooling air discharged from the cooling air distribution system of the support ring formed by the BOAS support segments 40, through the impingement holes 110 of the impingement buffer plate 108 into the annular cavity 114 (see FIG. 2). At least one of the cooling passages 116 which is particularly indicated as **116*a* and is positioned close to respective opposed circumferential sides 75 of each BOAS segment 36 (see FIG. 12) according to one embodiment, extends linearly from an inlet cavity 118*a* and is skewed away from the axial direction in order to direct cooling air to cool a corner area between the leading edge 72 and the respective opposed circumferential sides 75 of the platform 70. It may not be convenient or possible to position the inlet cavity 118*a* in a proximity of the respective opposed circumferential sides 75 of the platform 70 due to the existence of a seal slot 122 defined in the respective opposed circumferential sides 75 of the platform 70 and extending between the leading edge 72 and trailing edge 74 of the platform 70. The skewed orientation of the cooling passage 116*a* provides a solution in this circumstance to cool the corner areas of the leading edges 72 of the platform 70**.

The inlet cavities 118 (including **118*a*) extend radially and inwardly from the radially outer surface of the platform 70 to a depth at which inlet cavity 118 (or 118*a*) can communicate with the respective cooling passages 116 (or 116*a*) such that the cooling passages 116 (or 116*a*) are closer to a radially inner surface (not indicated) of the platform 70 and are radially spaced apart from the seal slots 122. The inlet cavity 118*a* is circumferentially spaced apart from the seal slot 122. An exit hole 120*a* of the cooling passage 116*a* may be circumferentially aligned with the seal slot 122 defined in the opposed circumferential sides 75 of the platform 70 (see FIG. 12**).

The platform 70 of the BOAS segment 36 is configured such that each of the seal slots 122 is in a curved shape and may have an opening 124 in the radially outer surface of the platform 70. The opening 124 has a size in the circumferential direction equal to the circumferential depth of the seal slot 122. Therefore, the inlet cavity **118*a* is circumferentially spaced apart from the opening 124 of the respective seal slots 122. It may be convenient for the cooling passage 116*a* and an adjacent cooling passage 116 to share the inlet cavity 118*a* due to the skewed orientation of the cooling passage 118*a*. In contrast to cylindrical inlet cavities 118 which communicate individually with the cooling passage 116, the shared inlet cavity 118*a*** may have a larger size in the circumferential direction such as in an oblong shape.

The leading edge 72 of the platform 70 may further define an axially outward projection configuration 126 to prevent the exit holes 120 on the leading edge 72 from being blocked by adjacent engine components when the BOAS assembly 34 is installed in the outer casing case 32 of the engine. Therefore, the cooling air passing through the cooling passages 116 and 116*a* cools the platform 70 of the respective BOAS segments 36 and is discharged through the exit holes 120, into the hot gas path defined by the turbine shroud.

The above description is meant to be exemplary only, and one skilled in the art will recognize that changes may be made to the embodiments described without departure from the scope of the described subject matter. For example, a turbofan gas turbine engine is used as an exemplary application of the described subject matter, however, other types of gas turbine engines are applicable for the described subject matter. Still other modifications which fall within the scope of the described subject matter will be apparent to those skilled in the art, in light of a review of this disclosure, and such modifications are intended to fall within the appended claims.

The invention claimed is:

1. A blade outer air seal assembly of a gas turbine engine having a main axis of rotation defining axial, radial and circumferential directions, the blade outer air seal assembly comprising:

an array of circumferentially adjoining blade outer air seal support segments forming a support ring; and an array of circumferentially adjoining blade outer air seal segments forming a static turbine shroud surrounding a turbine rotor, the turbine shroud being supported within the support ring, the blade outer air seal segments each including a platform extending axially from a leading edge to a trailing edge and circumferentially between opposed circumferential sides of the platform, front and rear hooks to support the platform radially and inwardly spaced apart from the support ring, to thereby define an annular cavity between the front and rear hooks, the platform defining a plurality of cooling passages extending axially through the platform, each of the cooling passages having an inlet defined in a radially outer surface of the platform and an exit defined on the leading edge, each inlet communicating with the annular cavity for intake of cooling air from the annular cavity, and wherein at least one of said cooling passages positioned close to the respective opposed circumferential sides extends linearly from one of the inlets and is circumferentially skewed away from the axial direction such that the at least one of said cooling passages has said inlet circumferentially spaced apart from an axial seal slot defined in the opposed circumferential sides of the platform and has an exit hole circumferentially aligned with said axial seal slot to thereby cool a corner area of the platform between the leading edge and the respective opposed circumferential sides.

2. The blade outer air seal assembly as defined in claim 1 wherein the respective seal slots of each blade outer air seal segment extend substantially axially.

3. The blade outer air seal assembly as defined in claim 1 wherein only the at least one cooling passage positioned close to the respective opposed circumferential sides shares one of said inlets with an adjacent cooling passage.

4. A blade outer air seal segment of a blade outer air seal assembly of a gas turbine engine having a main axis of rotation defining axial, radial and circumferential directions, the blade outer air seal segment comprising a platform extending axially from a leading edge to a trailing edge and circumferentially between opposed circumferential sides of the platform, the platform defining a seal slot positioned in the respective opposed circumferential sides and axially extending from a leading edge area toward the trailing edge and defining a plurality of cooling passages extending axially through the platform and exiting at the leading edge, the platform further defining a plurality of cavities in a radially outer surface of the platform, each cavity communicating with one of the passages to form an inlet with an enlarged diameter with respect to said one passage, wherein at least one of said cooling passages positioned close to the respective opposed circumferential sides extends linearly from one of the inlets and is circumferentially skewed away from the axial direction such that the at least one of said cooling passages has said inlet circumferentially spaced apart from the seal slot and has an exit hole circumferentially aligned with the seal slot, to thereby cool a corner area of the platform between the leading edge and the respective opposed circumferential sides while avoiding interference with the respective seal slots.

5. The blade outer air seal segment as defined in claim 4 wherein the cooling passages are positioned radially closer to a radially inner surface of the blade outer air seal segment than the seal slots.

6. The blade outer air seal segment as defined in claim 5 wherein the inlets extend radially and inwardly from the radially outer surface into the platform and are in communication with the respective cooling passages.

7. The blade outer air seal segment as defined in claim 4 wherein each of the seal slots defines an opening in the radially outer surface, the opening having a size in the circumferential direction, substantially equal to a circumferential depth of the seal slot.

8. The blade outer air seal segment as defined in claim 4 wherein only the inlet of the at least one cooling passage positioned close to the respective opposed circumferential sides, is shared with an adjacent cooling passage.

9. The blade outer air seal segment as defined in claim 8 wherein the respective shared inlets are oblong and the remaining inlets are cylindrical.

* * * * *